US005532433A

United States Patent [19]

Endo et al.

[11] Patent Number: 5,532,433

[45] Date of Patent: Jul. 2, 1996

[54] WATERPROOF-TYPE TERMINAL CONNECTION STRUCTURE AND METHOD OF PRODUCING SAME

[75] Inventors: Takayoshi Endo; Hiroki Kondo, both of Shizuoka, Japan

[73] Assignee: Yazaki Corporation, Tokyo, Japan

[21] Appl. No.: 245,904

[22] Filed: May 19, 1994

Related U.S. Application Data

[63] Continuation-in-part of Ser. No. 969,059, Oct. 30, 1992, abandoned.

[30] Foreign Application Priority Data

Nov. 13, 1991 [JP] Japan ..... 3-296941
Jun. 2, 1993 [JP] Japan ..... 5-154592

[51] Int. Cl.[6] ..... H01R 4/18; H01R 43/00

[52] U.S. Cl. ..... 174/84 C; 29/863; 174/77 R; 174/94 R; 439/203; 439/865; 439/936

[58] Field of Search ..... 174/77 R, 84 R, 174/84 C, 94 R; 29/863; 439/178, 179, 203, 880, 865, 866, 867, 868, 936

[56] References Cited

U.S. PATENT DOCUMENTS

| | | | |
|---|---|---|---|
| 2,815,497 | 12/1957 | Redslob . | |
| 2,901,722 | 8/1959 | Arnott, Jr. . | |
| 2,951,228 | 8/1960 | Dobaugh . | |
| 3,083,260 | 3/1963 | Bird . | |
| 3,892,459 | 7/1975 | Dittmann et al. | 439/442 |
| 3,924,057 | 12/1975 | Sosinski | 174/94 R |
| 3,931,671 | 1/1976 | Dittmann | 29/203 DT |
| 3,990,143 | 11/1976 | Dittmann et al. | 29/628 |
| 4,310,719 | 1/1982 | Cross et al. | 174/94 R |
| 4,464,541 | 8/1984 | Ceresa et al. | 174/84 C |
| 5,004,869 | 4/1991 | Koblitz et al. | 174/84 C |
| 5,302,146 | 4/1994 | Yamamoto | 439/877 |
| 5,316,506 | 5/1994 | Ito | 439/879 |

FOREIGN PATENT DOCUMENTS

| | | |
|---|---|---|
| 0070639 | 1/1983 | European Pat. Off. . |
| 2304932 | 8/1974 | Germany . |
| 2437278 | 2/1976 | Germany . |
| 51-14658 | 4/1976 | Japan . |
| 51-29504 | 7/1976 | Japan . |
| 51-108090 | 8/1976 | Japan . |
| 58-118674 | 8/1983 | Japan . |
| 1255812 | 10/1989 | Japan . |
| 2202696 | 9/1988 | United Kingdom . |

*Primary Examiner*—Morris H. Nimmo
*Attorney, Agent, or Firm*—Sughrue, Mion, Zinn, Macpeak & Seas

[57] ABSTRACT

There are provided a terminal connection structure and a method of producing the same, in which a terminal is positively and firmly press-connected to end portions or intermediate portions of electric wires, and the connection portion is rendered waterproof. Conductors of a plurality of electric wires are press-connected together by pressing pieces of a terminal through an organic seal material, and the conductors, as well as sheaths of the wires, are clamped together by the pressing pieces of the terminal, and each of the pressing pieces is pressed deeper at that portion thereof disposed on the conductors than at those portions thereof disposed on and adjacent to the sheaths, so that the organic seal material is filled in the conductors, in between the terminal and the conductors, and in between the terminal and the sheaths.

14 Claims, 6 Drawing Sheets

WATERPROOF-TYPE TERMINAL CONNECTION STRUCTURE AND METHOD OF PRODUCING SAME

This is a Continuation-in-Part of application Ser. No. 07/969,059, filed Oct. 30, 1992 now abandoned.

BACKGROUND OF THE INVENTION

1. Field of the Invention

This invention relates to a terminal connection structure in which a terminal is press-connected to end portions or intermediate portions of electric wires, and at the same time this connection portion is rendered waterproof. The invention also relates to a method of producing such a structure.

2. Related art

FIG. 4 is a perspective view of a conventional terminal connection structure.

In this structure, exposed conductors 19 of a plurality of electric wires 18 are press-connected together by a pair of pressing pieces 17 and 17 of a joint terminal 16, using a clamp jig (not shown).

Each conductor 19 is beforehand exposed by removing an end portion of a sheath of the wire 18, and as shown in FIG. 5 which is a cross-sectional view taken along the line 5—5 of FIG. 4, the conductors 19 are pressed between and connected to a base plate portion 21 and the pressing pieces 17 of the joint terminal 16.

In the above conventional structure, however, as shown in FIG. 5, spaces 22 are formed between element wires 19*a* of the conductors 19, between the element wires 19*a* and the base plate portion 21 and between the element wires 19*a* and the pressing pieces 17. There has been encountered a problem that water is introduced from the spaces 22 into the wires 18, and moves therealong to intrude into a connected device (not shown) to cause electrocorrosion (corrosion). Another problem is that because of the provision of the spaces 22, an electrical contact resistance between the element wire 19*a*, as well as an electrical contact resistance between the element wires 19*a* and the terminal 16, increases. A further drawback is that where the conductor 19 is narrow, the element wire 19*a* is liable to rupture by a tension or the like.

For another example, a waterproof connector shown in FIG. 11 has been generally known as a waterproof connector using a holding and clamping terminal. In this waterproof connector, a terminal 130 is received in a terminal receiving portion 125 of a connector housing 124. An insulated wire 121 is inserted into a waterproof rubber plug 126 so as to tightly contact therewith, and the waterproof rubber plug 126 is fitted into the terminal receiving portion 125 so as to tightly contact therewith to block the terminal receiving portion 125.

On the other hand, the terminal 130 is formed by the working of punching a conductive metal plate. The terminal 130 has an insulation barrel 130*a* for holding and clamping a small-diameter cylindrical portion 128 of the waterproof rubber plug 126 so as to hold the cylindrical portion 128 together with the insulated wire inserted into the cylindrical portion 128, and a wire barrel 130*c* for holding and clamping conductors 123 exposed by separating an insulating coating 121.

Thus, in the waterproof connector having such a conventional structure, the waterproof rubber plug 126 cuts off water which would enter the terminal receiving portion along the outer wall surface of the housing. At the same time, the insulation barrel 130*a* urges the rubber plug 126 against the outer surface of the wire, so that the terminal can prevent water which would enter the terminal receiving portion through a wire insertion portion of the rubber plug 126. In such a manner, the waterproof connector is made superior in watertight structure.

In the above-mentioned waterproof connector, however, for example, in such a case where the connector-connected wire 121 is further branched and connected through a joint terminal 131 as shown in FIG. 11, there has been a case where water (shown by the arrow in the drawing) intrudes into a wire coating through a wire-terminal portion connected to the joint terminal 131, passes a wire connection portion which has been press fitted by the insulation barrel 130*a*, and flows into the terminal receiving portion 125 between the conductors 123. Accordingly, there has been a fear that a leak current is generated between adjacent terminals.

As means to solve the foregoing problem, it can be considered that a terminal has such a shape that an insulating coating portion and conductors of a wire end portion can be held and cramped integrally and continuously so that water intruding between the conductors cannot leak out of the terminal. However, in such a structure where the insulating coating and the conductors are held and cramped integrally, there has been a problem that the property of electric contact in a conductor held and cramped portion is deteriorated by the difference in holding and clamping diameter so as to decrease reliability.

Means to prevent water from flowing out of a terminal is disclosed in Japanese Patent Unexamined Publication No. Sho-60-119086. In this means, a cap is provided to cover a wire connection portion of a terminal, and a sealing material is charged into the cap. In this means, it is indeed possible to obtain a waterproof effect at a wire end portion including a terminal, but it has not been considered to make the water proof effective to the whole of the connector including its housing.

SUMMARY OF THE INVENTION

With the above problems in view, it is an object of this invention to provide a waterproof-type terminal connection structure in which the intrusion of water into an electric wire can be surely prevented, and connection portions of the wires can be connected together positively and firmly without increasing a contact resistance. Another object is to provide a method of producing such a structure.

Another object of the present invention to provide a connector termination structure and a connector termination method, in which water intruding into a wire coating can be cut off, and high reliability can be obtained in the property of electric contact between conductors and terminal metal members.

The above object has been achieved by a waterproof-type terminal connection structure wherein conductors of a plurality of electric wires are press-connected together by pressing pieces of a terminal through an organic seal material, characterized in that said conductors, as well as sheaths of said wires, are clamped together by said pressing pieces of said terminal; and each of said pressing pieces is pressed deeper at that portion thereof disposed on said conductors than at those portions thereof disposed on and adjacent to said sheaths, so that said organic seal material is filled in said conductors, in between said terminal and said conductors, and in between said terminal and said sheaths. The above object has also been achieved by a method of producing a waterproof-type terminal connection structure, characterized in that conductors of a plurality of electric wires, as well as sheaths of said wires, are press-connected together by pressing pieces of a terminal through an organic seal material; each of said pressing pieces is pressed deeper at that portion thereof disposed on said conductors than at those portions thereof disposed on and adjacent to said sheaths, so that said organic seal material, poured inside the pressing pieces, is forced toward said sheaths to seal the connection portion.

The foregoing object of the present invention can be achieved by a waterproof connector termination structure in which a terminal is connected to an insulated wire inserted into a waterproof rubber plug fitted into a connector housing, characterized in that the terminal has such a shape that a paste-like sealing material can be spread and that an insulating coating of the insulated wire and conductors of the insulated wire exposed at its wire end portion can be press fitted integrally and continuously.

The foregoing object of the present invention can be achieved also a waterproof connector termination method in which a terminal is connected to an insulated wire inserted through a waterproof rubber plug, characterized in that after an insulating coating of the insulated wire and conductors of the insulated wire exposed at its wire end portion are press fitted integrally and continuously by means of a wire press fitting portion of the terminal on which a paste-like sealing material is spread, the waterproof rubber plug is fitted into a connector housing.

By pressing the pressing-pieces, the organic seal material fills in the gaps in the conductors (between the element wires) and in the gaps between the terminal and the conductors. That portion of the pressing piece disposed on the conductors are pressed deeper, and therefore the organic seal material is forced toward the sheaths, and this pressure introduces the organic seal material into the sheaths, thereby imparting a positive waterproof to the interiors of the wires. And besides, since the sheaths of the wires are clamped together by the pressing piece, an undue stress will not be exerted on the conductors, thereby preventing the cutting of the conductor. Further, the organic seal material strongly urges the conductors of the wires against the terminal, thereby improving an electrical contact. With the use of the electrically-conductive organic seal material, the conductivity between the element wires, as well as the conductivity between the element wires and the terminal, is enhanced.

The terminal has a structure in which conductors exposed at its wire end portion and an insulating coating are press fitted integrally and continuously so that the terminal substantially encloses the conductors and the insulating coating. Accordingly, it is possible to perfectly prevent water from flowing out of the terminal.

In addition, a paste-like sealing material is charged between the conductors by press fitting the terminal. Accordingly the sealing material cuts off water intruding along the conductors inside the wire coating, and the contact resistance between the conductors and terminal metal members is prevented from increasing, so that it is possible to improve the reliability in electric performance.

BRIEF DESCRIPTION OF THE DRAWINGS

In the accompanying drawings:

FIG. 3 (B) is a perspective view of the joint terminal illustrated in FIG. 3(A);

FIG. 7 is applied;

FIG. 9 (B) is a sectional view taken on line 9B—9B of FIG. 8;

DESCRIPTION OF THE PREFERRED EMBODIMENT

Preferred embodiments of the present invention will now be described with reference to FIGS. 1 to 3.

Figure 1:
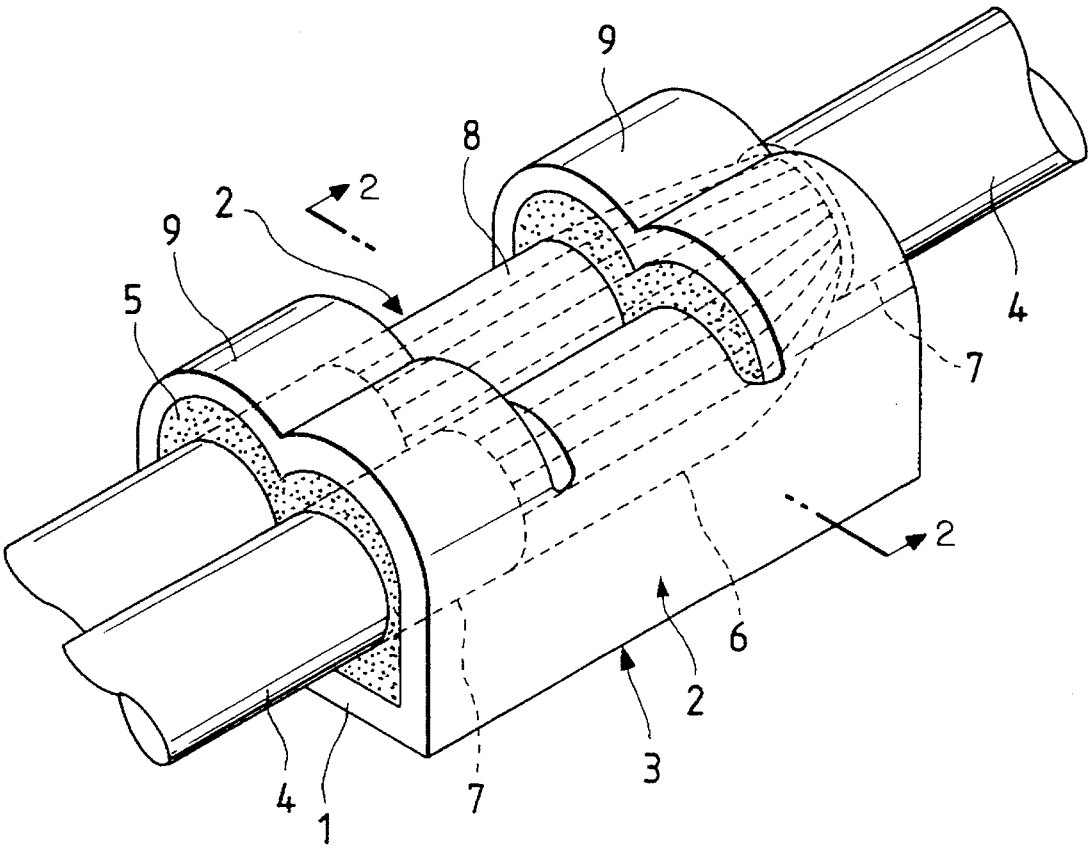
FIG. 1 is a perspective view of first embodiment of a waterproof-type terminal connection structure of the present invention.
Figure 2:
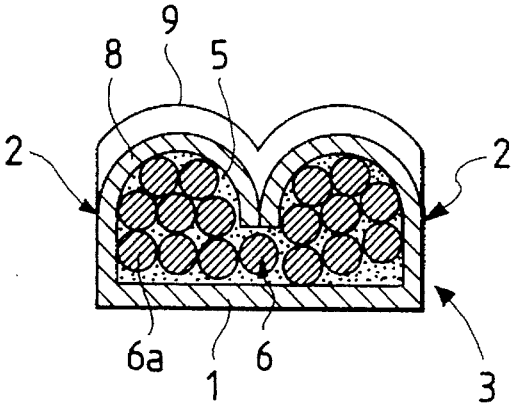
FIG. 2 is a cross-sectional view taken along the line 2—2 of FIG. 1.
Figure 3A:
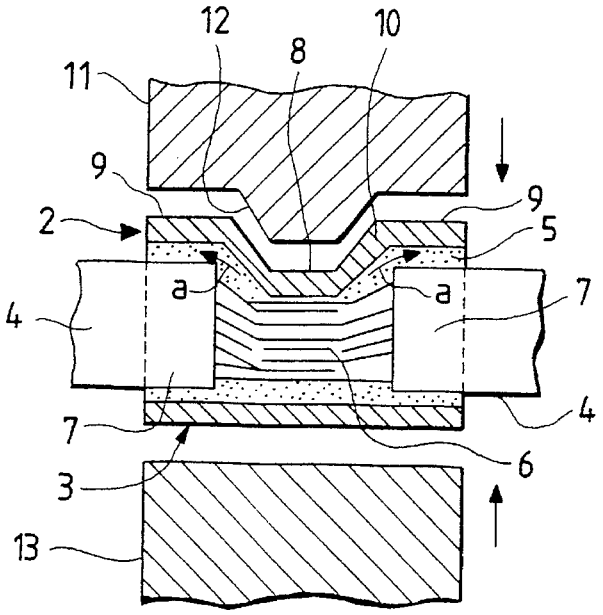
FIG. 3 (A) is a vertical cross-sectional view showing a method of producing a connection structure according to another embodiment of the invention.
Figure 3B:
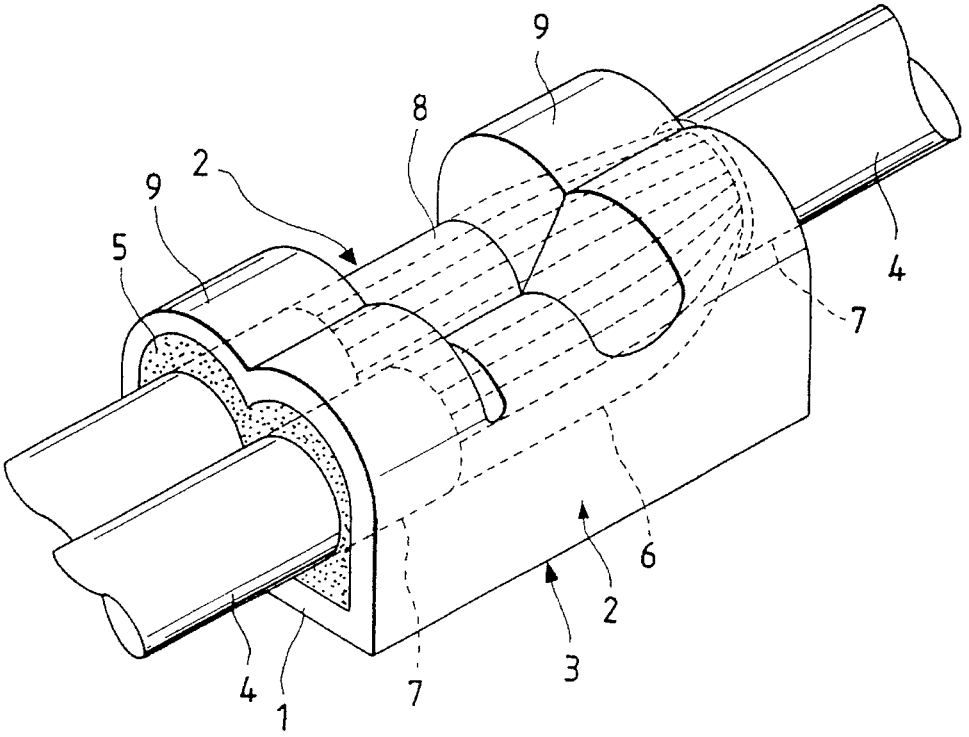
Figure 4:
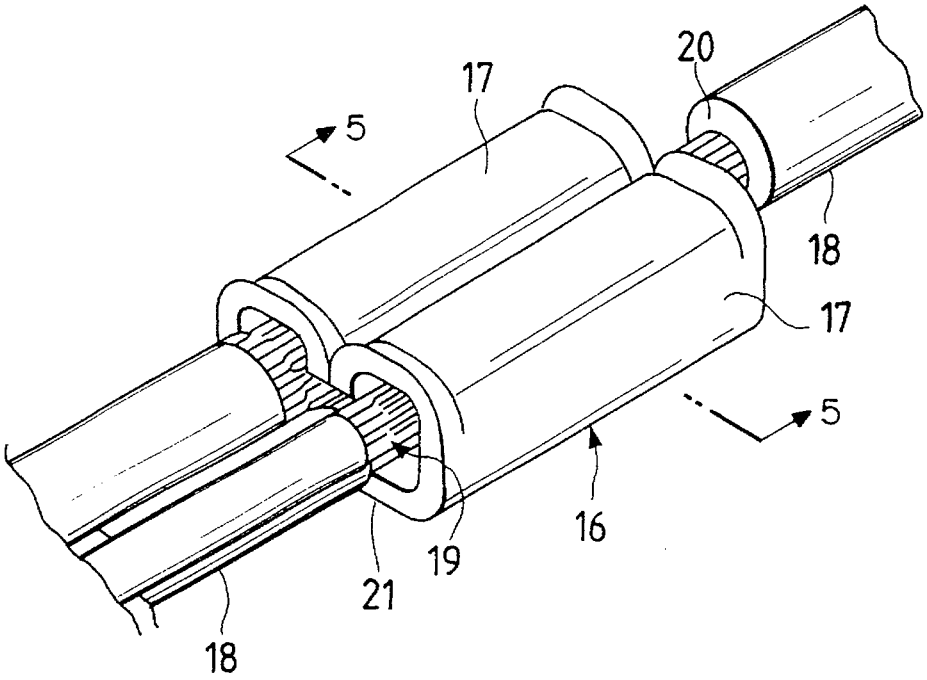
FIG. 4 PRIOR ART
FIG. 4 is a perspective view of a conventional example.
Figure 5:
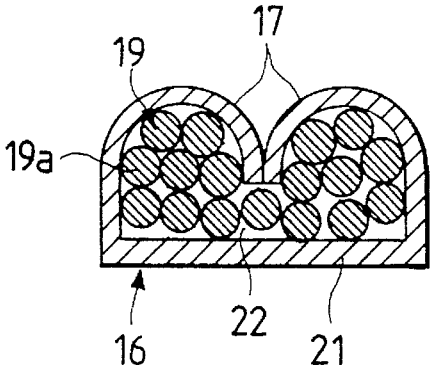
FIG. 5 PRIOR ART
FIG. 5 a cross-sectional view taken along the line 5—5 FIG. 4.

FIGS. 1 to 3 show a first embodiment of the present invention. As shown in FIG. 1, electric wires (main wire and branch wires) 4 are set in a joint terminal 3 from front and rear sides thereof, respectively. The joint terminal 3 has a pair of pressing pieces 2 and 2 formed respectively on opposite sides of a base plate portion 1, each pressing pieces 2, in this case, having two sheath-pressing pieces at both ends for holding and clamping sheaths 7 of the wires 4 and a conductor-pressing pieces 8 interposed therebetween for holding and clamping exposed conductors 6 of the wires 4. A paste-like organic seal material 5 of an epoxy resin or the like is poured to the terminal 3 between the pair of the pressing pieces 2, and the exposed conductors 6 and sheaths 7 are thereafter clamped by the pressing pieces 2 in such a manner that the conductor-pressing pieces 8 are pressed deeper against the conductors 6 through the material 5 than the sheath-pressing pieces 9 against the sheath 7 through the material 5. Since the conductor-pressing piece 8 are pressed deeper than the sheath-pressing pieces 9, the seal material 5 is forced toward the sheaths 7 to improve the waterproof property.

In the embodiment shown in FIG. 1, the conductor-pressing pieces 8 and the sheath-pressing piece 9 are separately or divisionally formed on the pressing piece 2, but the present invention should not be restricted thereto or thereby. For example, deformation of the pressing member 2 is partially varied to use a part of the pressing member 2 as a conductor-pressing portion 8 and the other part thereof as a sheath-pressing member 9. FIG. 3 shows such embodiment of the present invention.

As shown in FIGS. 3(A) and (B), since the pressing member 2 is formed such that the conductor-pressing portion 8 is consecutive to the sheath-pressing portion 9, a tapered portion 10 is formed between the conductor-pressing portion 8 and the sheath-pressing portion 9 after the pressing portion 2 is bent and deformed. Such deformation can be achieved by a clamp jig having an upper die whose conductor-pressing projection 12 is formed into a mountain-like tapered configuration in cross-section as shown in FIG. 3.

The conductors 6 are strongly compressed together with the organic seal material 5 by the conductor-pressing portion 8 compressed between the upper die 11 and a lower die 13. The organic seal material 5 is strongly forced toward the ends of the sheaths 7 along the tapered portions 10 as indicated by arrows a and a, so that the organic seal material 5 is filled in between the sheath 7 and the sheath-pressing portion 9, and at the same time this pressure introduces the organic seal material into the wires 4. Also, as shown in FIG. 2, the organic seal material 5 is filled in between element wires 6*a* of the conductors 6 and in between the element wires 6*a* and the terminal 3, and therefore in addition to the waterproof effect, an improved electrical contact is achieved by the pressing effect of the organic seal material 5.

The sheaths 7 are clamped together by the sheath-pressing portion 9, and therefore when tension is applied to the wire 4, the sheath-pressing portion 9 receives this force, thereby preventing a rupture of the element wires 6*a*. In addition, since the degree of filling of the organic seal material 5 can be confirmed visually from the end of the sheath-pressing portion 9, the filling amount can be easily adjusted.

The organic seal material 5 is known from Japanese Laid-Open Patent Application No. 1-258381, and its examples include an epoxy resin, a polyester resin, an acrylic resin, a phenolic resin of a thermosetting type or a thermoplastic type. Preferably, the thermal deformation temperature of the organic seal material 5 should not be less than 100° C. so that it will not flow when eddy current flows.

As is known Japanese Laid-Open Patent Application No. 1-258382, the organic seal material 5 may contain powder of an electrically-conductive material, such as copper powder and aluminum powder, and with the use of such electrically-conductive organic seal material, the electrical conductivity between the element wires 6*a*, as well as the electrical conductivity between the element wires 6*a* and the terminal 3, can be enhanced.

The terminal is not limited to the joint terminal 3 shown in FIG. 1, but may be a crimp-style terminal of a male or a female type (not shown).

As described above, in the present invention, the organic seal material is filled in the gaps in the conductors of the wire (between the element wires) and in the gaps between the terminal and the conductors, and at the same time the organic seal material is introduced into and inside the sheaths by the pressure produced when that portion of each pressing-piece disposed on the conductors is pressed deeper. Therefore, the interior of the wire is positively rendered waterproof, and the electrocorrosion of the connected device is prevented.

In addition, since the sheaths are also clamped by the pressing piece, the cutting of the conductors is prevented.

Further, the organic seal material strongly presses the conductors against the terminal, thereby improving the electrical contact. By containing metal powder in the organic seal material, the electrical contact resistance between the element wires, as well as the electrical contact resistance between the element wires and the terminal, is reduced, thereby improving the electrical conductivity.

A second embodiment of the present invention will be described in detail with reference to FIGS. 6 to 10.

Figure 6:
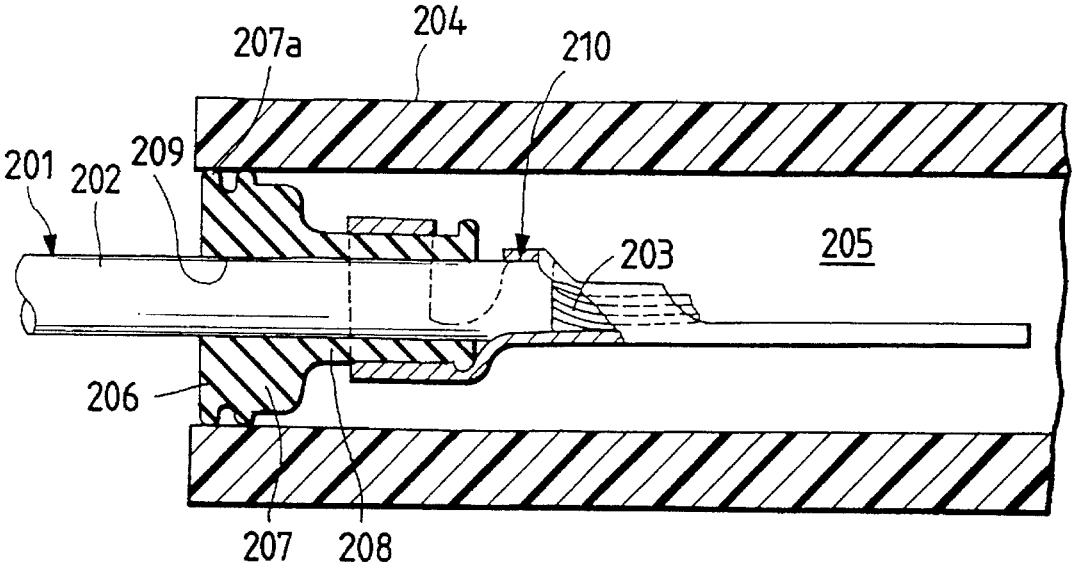
FIG. 6 is a main portion longitudinal sectional view illustrating a second embodiment of the waterproof connector termination structure according the present invention.

In FIG. 6, this waterproof connector has a termination structure constituted by a waterproof rubber plug 206 which is penetrated by an insulated wire 201 and which is inserted into a terminal receiving portion 205 formed in a housing 204, and a press-fitting terminal 210 which is connected to a wire end portion of the insulated wire 201 which is inserted through the rubber plug 206.

The waterproof rubber plug 206 per se has a conventional configuration. That is, the waterproof rubber plug 206 is constituted by a large-diameter portion 207 which is annular and thick, and a small-diameter cylindrical portion 208 which is formed continuously and integrally with the large-diameter portion 207 with a wire insertion hole 209 which is formed so as to have a uniform diameter through the portions 207 and 208.

A plurality of projecting engagement strips 207*a* are provided around the outer circumference of the large-diameter portion 207. When the rubber plug 206 is fitted into the terminal receiving portion 206, the engagement strips 207*a* are transformed elastically so as to bring the rubber plug 206 into tight contact with the inner wall surface of the receiving portion 206.

The wire insertion hole 209 has a large enough inner diameter to insert an insulating coating 202 of the wire 201 therethrough, and is provided so as to be brought into tight contact with the insulating coating 202 when the small-diameter cylindrical portion 208 is press fitted by the terminal 210 as will be described later.

Figure 7:
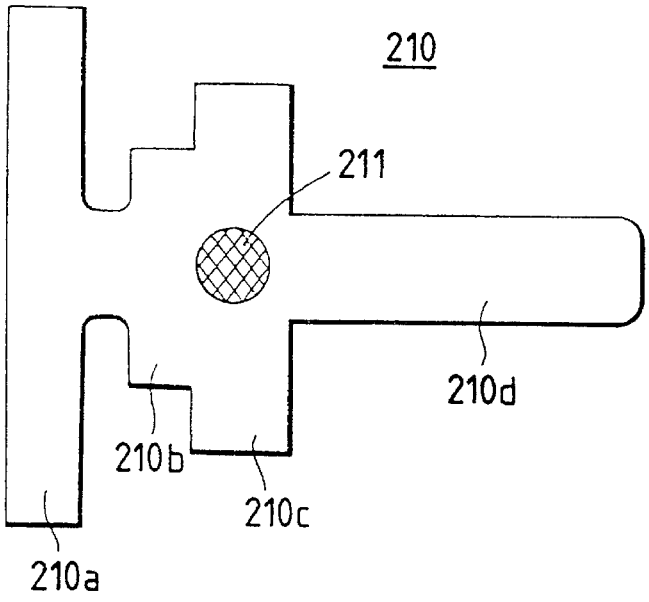
FIG. 7 is a development diagram of a terminal used in the waterproof connector in FIG. 6.

The terminal 210 is prepared by punching an electrically conductive metal plate so as to have such a shape of development as shown in FIG. 7. The terminal 210 described in this embodiment is formed into a male tab.

The terminal 210 is formed to have an insulation barrel 210*a* having the longest size in development, a newly provided barrel 210*b* having the shortest size in development and being a constituent element which is one feature of this embodiment, a wire barrel 210*c* having a shape continued to the newly provided barrel 210*b*, and a terminal portion 210*d* which acts as an electrical contact portion.

The insulation barrel 210*a* can hold the small-diameter cylindrical portion 208 of the rubber plug 206 so as to press fit the small-diameter cylindrical portion 208 together with the insulating coating 202 of the insulated wire 201 inserted into the small-diameter cylindrical portion 208.

The newly provided barrel 210*b* can hold and press fit the insulating coating 202 which belongs to the insulated wire 1 penetrating the rubber plug 206 and is elongated from the top end of the rubber plug 206.

The wire barrel 210*c* can press fit conductors 203 which are penetrated through the rubber plug 206 so as to be exposed with the insulating coating 202 by predetermined length. The conductors 203 are press fitted integrally with the newly provided barrel 210*b*.

A paste-like sealing material 211 is spread on the terminal 210 at least at a center portion of the wire barrel 210*c* in the surface of development of the terminal 210.

Organic sealing materials having thermal transformation temperature not lower than 100° C., or organic sealing resin having thermal transformation temperature not lower than 100° C. and containing metal powder dispersed therein, may be used as the above-mentioned paste-like sealing material.

That is, sealing materials of a thermosetting resin system, sealing material of a thermoplastic resin system, or mixtures of the both, may be used as the organic sealing materials or organic resin. For example, the examples of the organic sealing materials or organic resin may include polyester resin, polyolefin resin, acrylic resin, epoxy resin, polyimide resin, polyurethane resin, phenolic resin, vinyl chloride resin, melamine resin, polyether sulfonic resin, polyphenylene sulfide resin, polyether imide resin, polyphenylene oxide resin, bismale imide resin, bismale imide triazine resin, and so on.

Example of the metal powder may include copper powder, silver powder, carbon powder, brass powder, stainless steel powder, aluminum powder, nickel powder, iron powder, and so on, and mixture powder of them. As for the particle size of the metal powder, the average size 0.01 to 50 & Lm is preferable. As for the content of the metal powder in the organic resin, 1 to 85 weight % of the metal powder to organic resin solid is preferable.

As for the paste-like sealing material, the viscosity 200 to 500 poise is preferable.

Figure 8:
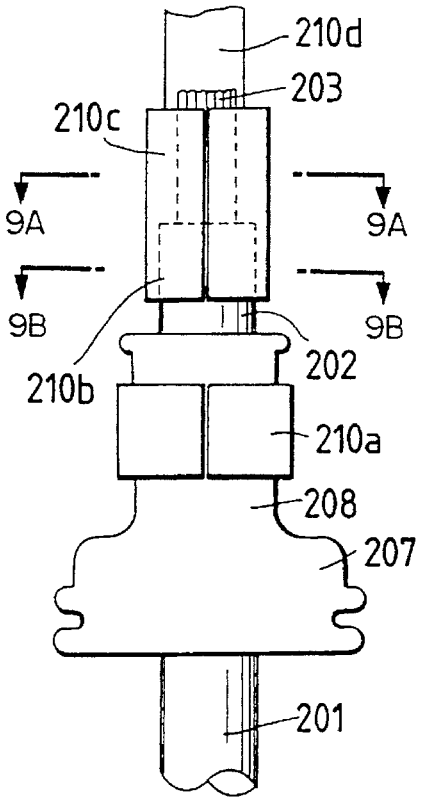
FIG. 8 is a main portion plan view illustrating a termination structure to which the terminal

Next, a waterproof connector termination method will be described in connection with the process of assembling of the waterproof connector with reference to FIGS. 8 and 9.

First, in order to attach the waterproof rubber plug 206 to the insulated wire 201, the insulated wire 201 is inserted into and through the wire insertion hole 209 of the rubber plug 206, and projected out of the small-diameter cylindrical portion 208. In the projected wire 201, the insulating coating 202 is removed so as to expose the conductors 203 in the end portion in a state that the insulating coating 202 is projected from the top end of the small-diameter cylindrical portion 208.

The small-diameter cylindrical portion 208 of the waterproof rubber plug 206 penetrated by the wire 201 is disposed on the insulation barrel 210*a* of the terminal 210. The small-diameter cylindrical portion 208 is press fitted by the barrel 210*a*. Consequently the waterproof rubber plug 206 is pressed so that the space between the wire insertion hole 209 and the outer circumference of the insulating coating 202 of the wire 1 is made tight enough to cut off water intruding into the wire insertion hole 209 along the wire outer circumference.

The insulating coating 202 extended so as to project from the top end of the rubber plug 206 is disposed on the newly provided barrel 210*b* of the terminal 210. At the same time, the conductors 3 exposed from the insulating coating 202 are disposed on the wire barrel 210*c*. Both the barrels 210*b* and 210*c* are press fitted. Accordingly, since both the barrels 210*b* and 210*c* are provided in an integral and continuous shape, the barrels 210*b* and 210*c* substantially enclose the end portion of the insulating coating 202 and the conductors 203 as shown in FIG. 8 so as to bring the end portion of the insulating coating 202 and the conductors 203 into not-exposed state. Thus, water can be prevented from flowing out from the terminal portion.

Figure 9A:
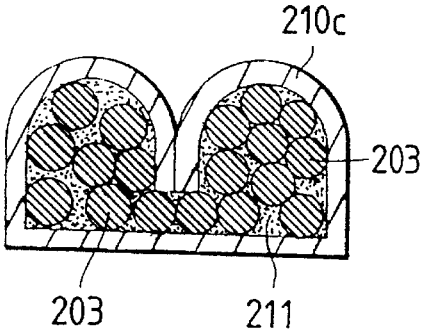
FIG. 9 (A) is a sectional view taken on line 9A—9A of FIG. 8.

More in detail, as for the effects of the barrels 210*b* and 210*c*, the wire barrel 210*c* formed longer in barrel size than the newly provided barrel 210*b* is designed so that the barrel top and intrudes into the conductors 203 deeply by pressing as shown in FIG. 9(A). Accordingly the wire barrel 210*c* acts effectively in electrical connection with the conductors 203. Further, the paste-like sealing material 211 is charged into the space between the conductors 203 by pressing, so that the contact resistance in the pressing portion is prevented from increasing to thereby ensure high reliability in electrical contact. In addition, this sealing material has another effect to cut off water intruding between the conductors and prevent the water from leaking out of the terminal top end portion to the terminal receiving portion.

Figure 9B:
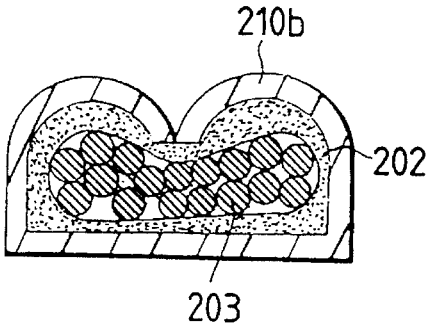

On the other hand, the newly provided barrel 210*b* shorter in barrel size than the wire barrel 210*c* can hold the insulating coating 202 without injuring the insulating coating 202 so as to press the insulating coating 202 and the conductors 203 when the newly provided barrel 210*b* is press fitted together with the wire barrel 210*c* as shown in FIG. 9 (B). Since the end portion of the insulating coating 202 is enclosed within the terminal, water can be prevented from flowing out of the terminal portion of the coating 202.

Finally, the terminal 210 connected with the insulating wire 201 is inserted into the terminal receiving portion 205. At the same time, the rubber plug 206 is fitted into the terminal receiving portion 205. Thus the assembly of the waterproof connector is completed.

Figure 10:
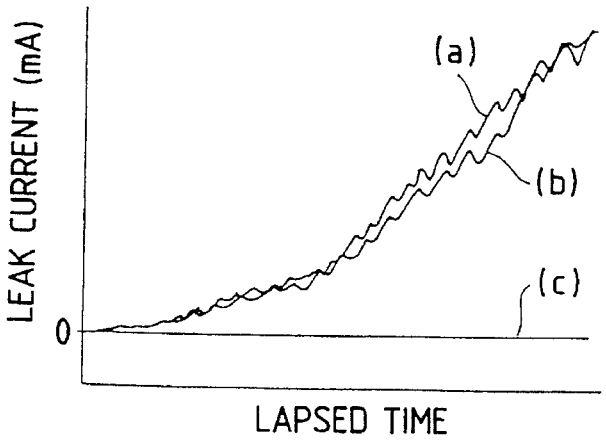
FIG. 10 is a diagram illustrating the result of experiment in which the present invention was compared with comparative examples.
Figure 11:
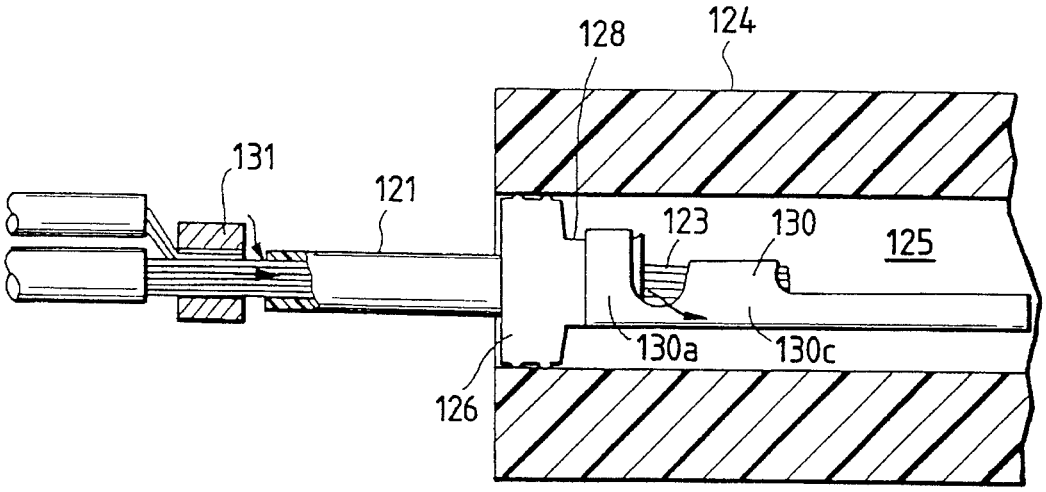
FIG. 11 is a partially sectional view illustrating a termination structure of a conventional waterproof connector.

FIG. 10 shows the result of experiments in which the waterproof connector according to the present invention was compared with waterproof connector according to conventional structures. In the drawing, the diagrams (a) and (b) correspond to conventional structures, (a) showing a structure (refer to FIG. 11) in which an insulation barrel of a terminal press fits a wire through a waterproof rubber plug, and a wire barrel press fits conductors, (b) showing a structure in which a sealing material is applied to a conductor press fitting portion of the (a) type, while the diagram (c) shows a structure according to the present invention.

As is apparent from this experimental result, it was found that in the structures (a) and (b) a leak current increased between poles as time went so as to produce electric erosion, and at last reached the burning of the terminal. On the other hand, in the structure (c), it was confirmed that no leak current was produced at all.

As has been described above, according to the termination structure and termination method of the present invention, a terminal encloses conductors of an insulated wire so as to make a border portion between the conductors and an insulating coating be received in the terminal not to be exposed. Accordingly, it is possible to cut off the flow of water leaking out of the border portion, so that it is possible to prevent a leak current from being generated. Further, the increase of contact resistance produced by press fitting the insulating coating together with the conductors is restrained by charging a sealing material into a press fitting portion. Accordingly, it is possible to ensure high reliability. In addition, this sealing material is charged into the space between the conductors, so that it is also possible to prevent water from intruding. Thus, it is possible to realize and provide a perfect waterproof connector.

Although the invention has been described and shown in terms of preferred embodiments thereof, it will be understood by those skilled in the art that changes in form and detail may be made therein without departing from the spirit and scope of the invention as defined in the appended claims.

What is claimed is:

1. A structure for holding at least one electric wire on a connector for electrical connection, comprising:

a base plate portion;

a pair of pressing pieces formed respectively on opposite sides of said base plate portion for holding and clamping at least one electric wire; and a sealing material;

each of said pressing pieces including a first section for holding and clamping an exposed conductor of said electric wire through said sealing material and a second section for holding and clamping a sheath portion of said electric wire adjacent to said exposed conductor through said sealing material, wherein a height defined between said first section and said base plate portion is less than that defined between said second section and said base plate portion so that when said pressing pieces are clamped, at least some of said sealing material is forced from said first section toward said second section such that said sealing material is filled around said exposed conductor and said sheath portion in a continuous manner.

2. The structure according to claim 1, wherein said first and second sections are longitudinally separated from each other.

3. The structure according to claim 1, wherein said first and second sections are longitudinally consecutive to each other through a slope portion.

4. The structure according to claim 1, wherein said sealing material is electroconductive.

5. A structure for holding at least one electric wire on a connector for electrical connection, comprising:

a base plate portion; and a pair of pressing pieces formed respectively on opposite sides of said base plate portion for holding and clamping at least one electric wire;

each of said pressing pieces including a first section for holding and clamping an exposed conductor of said electric wire through a sealing material and a second section for holding and clamping a sheath portion of said electric wire adjacent to said exposed conductor, wherein the first section includes a wire barrel portion for holding and clamping an exposed conductor of the electric wire, the wire barrel portion being integrally formed to the base plate portion and the second section includes a barrel portion for holding the sheath portion of the electric wire, the barrel portion being integrally formed to the wire barrel portion; and an insulation barrel portion for holding the electric wire and a rubber plug, the insulation barrel portion being integrally formed to the barrel portion, wherein the sealing material seals a space defined between the exposed conductor, and the sealing material is provided on at least a center portion of the wire barrel portion.

6. A structure for holding at least one electric wire as claimed in claim 5, wherein a length of the wire barrel portion is shorter than a length of the insulation barrel portion and a length of the barrel portion is shorter than the length of the wire barrel portion.

7. A water proof terminal comprising:

a terminal portion serving as an electric contact portion;

a wire barrel portion for holding and clamping a conductor of an electric wire, the wire barrel portion being integrally formed to the terminal portion;

a barrel portion for holding a sheath portion of the electric wire, the barrel portion being integrally formed to the wire barrel portion;

an insulation barrel portion for holding the electric wire and a rubber plug, the insulation barrel portion being integrally formed to the barrel portion; and a sealing material for sealing a space defined between the conductors, the sealing material being provided on at least a center portion of the wire barrel portion.

8. A water proof terminal as claimed in claim 7, wherein a length of the wire barrel portion is shorter than a length of the insulation barrel portion and a length of the barrel portion is shorter than the length of the wire barrel portion.

9. A water proof terminal as claimed in claim 7, wherein the sealing member includes paste-like sealing material.

10. A water proof terminal as claimed in claim 9, wherein the paste-like sealing material includes organic sealing materials having thermal transformation temperature not lower than 100° C.

11. A water proof terminal as claimed in claim 9, wherein the paste-like material including metal powder.

12. A water proof terminal as claimed in claim 9, wherein the paste-like sealing material has a viscosity of 200 to 500 poise.

13. A water proof terminal as claimed in claim 7, wherein the wire barrel portion and the barrel portion hold integrally the conductor and the sheath portion of the electric wire, respectively.

14. A method of crimping an electric wire to a terminal including a base plate portion and a pair of pressing pieces formed respectively on opposite sides of said base plate portion and defining a wire receiving portion therebetween, each of said pressing pieces including a first section and a second section, comprising the following steps:

stripping a portion of a sheath of said wire from an end portion of said wire to expose a conductor of said wire;

placing said end portion of said wire into said wire receiving portion of said terminal;

applying a sealing material to said exposed conductor and an adjacent sheath portion of said wire;

crimping said first and second sections of said pressing pieces such that said first section clamps said exposed conductor and said second section clamps said adjacent sheath portion of said wire in such a manner that a height between said first section and said base plate portion is smaller than a height between said second section and said base plate portion, whereby at least some of said sealing material is force from said first section toward said second section such that said sealing material is filled around said exposed conductor and said adjacent sheath portion in a continuous manner.

* * * * *